US007104480B2

(12) United States Patent
Lutz

(10) Patent No.: US 7,104,480 B2
(45) Date of Patent: Sep. 12, 2006

(54) REFINER SENSOR AND COUPLING ARRANGEMENT

(75) Inventor: Mark S. Lutz, West Allis, WI (US)

(73) Assignee: J&L Fiber Services, Inc., Waukesha, WI (US)

( * ) Notice: Subject to any disclaimer, the term of this patent is extended or adjusted under 35 U.S.C. 154(b) by 140 days.

(21) Appl. No.: 10/808,222

(22) Filed: Mar. 23, 2004

(65) Prior Publication Data

US 2005/0211809 A1 Sep. 29, 2005

(51) Int. Cl.
*B02C 4/32* (2006.01)
*B02C 7/04* (2006.01)
*B02C 1/10* (2006.01)

(52) U.S. Cl. ..... 241/34; 241/261.2; 241/296

(58) Field of Classification Search ..... 241/34, 241/261.2, 261.3, 296, 297, 298; 73/862.08
See application file for complete search history.

(56) References Cited

U.S. PATENT DOCUMENTS 1,151,131 A 8/1915 Starliper
2,116,584 A 5/1938 Shelby
2,335,358 A 11/1943 Ray
2,353,444 A 7/1944 Conradty et al.
2,843,646 A 7/1958 Conant
3,069,752 A 12/1962 Sherning
3,091,844 A 6/1963 Laine
3,309,031 A 3/1967 McMahon et al.
3,379,578 A 4/1968 McTaggart et al.
3,466,200 A 9/1969 Mellor et al.
3,539,400 A 11/1970 Pustell
3,553,827 A 1/1971 Baker et al.
3,604,645 A 9/1971 Keyes, IV
3,617,006 A 11/1971 Jones
3,617,717 A 11/1971 Smith
3,650,891 A 3/1972 Dahlin
3,711,687 A 1/1973 Stout et al.
3,847,359 A 11/1974 Holmes et al.
3,867,205 A 2/1975 Schley
3,947,668 A 3/1976 Al-Shaikh et al.

(Continued)

FOREIGN PATENT DOCUMENTS

CH 546600 3/1974

(Continued)

OTHER PUBLICATIONS

W.E. Lunan, K.B. Miles and W.D. May, The Effect of Differential Pressure on Energy Consumption in Thermo-mechanical Pulping, Journal of Pulp and Paper Science; vol. 11, No. 5, Sep. 1985, pp. J129-J135.

(Continued)

*Primary Examiner*—Faye Francis
(74) *Attorney, Agent, or Firm*—Michael Best & Friedrich LLP

(57) ABSTRACT

A sensor assembly and coupling arrangement for a rotary disk refiner. The sensor assembly includes a housing formed by a base and frustoconical cap that has a sensing element carrying bulb extending outwardly therefrom. The coupling arrangement includes a conduit arrangement that is received in one or more aligned preexisting instrument ports of the refiner and that releasably couples with a connector puck. The puck is carried by the backside of a refiner disk segment that lies next to the refiner disk segment that is equipped with one or more sensor assemblies. Preferably, a flexible hose communicates sensor wiring from a sensor manifold that holds a plurality of sensor assemblies to the connector puck. The sensor manifold preferably is carried by the backside of the sensor refiner disk.

19 Claims, 8 Drawing Sheets

U.S. PATENT DOCUMENTS 4,023,739 A 5/1977 Lampe et al.
4,060,716 A 11/1977 Pekrul et al.
4,070,761 A 1/1978 Collins
4,071,451 A 1/1978 Wood
4,148,439 A 4/1979 Floden
4,184,204 A 1/1980 Flohr
4,211,324 A 7/1980 Ohlbach
4,227,927 A 10/1980 Black et al.
4,268,381 A 5/1981 Hooper
4,313,465 A 2/1982 Holzem et al.
4,314,878 A 2/1982 Lee
4,430,221 A 2/1984 Spiewok
4,454,991 A 6/1984 Brenholdt
4,498,137 A 2/1985 Flohr
4,581,300 A 4/1986 Hoppin, III et al.
4,581,813 A 4/1986 Terhune
4,582,568 A 4/1986 Iyengar
4,587,707 A 5/1986 Nishida et al.
4,614,296 A 9/1986 Lesgourgues
4,626,318 A 12/1986 Prough et al.
4,627,578 A 12/1986 Whyte
4,661,911 A 4/1987 Ellery, Sr.
4,670,215 A 6/1987 Morishita et al.
4,672,529 A 6/1987 Kupersmit
4,673,875 A 6/1987 Kjellqvist et al.
4,688,726 A 8/1987 Brenholdt
4,730,252 A 3/1988 Bradshaw
4,745,254 A 5/1988 Funk
4,820,980 A 4/1989 Dodson-Edgars
4,837,417 A 6/1989 Funk
4,858,103 A 8/1989 Takeuchi et al.
4,878,020 A 10/1989 Karna et al.
4,887,208 A 12/1989 Schneider et al.
4,920,488 A 4/1990 Filley
4,943,347 A 7/1990 Floden
4,950,986 A 8/1990 Guerrero
4,972,318 A 11/1990 Brown et al.
4,980,123 A 12/1990 Gedeon et al.
4,994,971 A 2/1991 Poelstra
5,007,985 A 4/1991 Engstrand et al.
5,009,774 A 4/1991 LeBlanc
5,011,065 A 4/1991 Musselmann
5,011,088 A 4/1991 Savonjousi
5,011,090 A 4/1991 Savonjousi
5,016,824 A 5/1991 Pietinen et al.
5,042,726 A 8/1991 Reinhall
5,063,380 A 11/1991 Wakura
5,064,536 A 11/1991 Bratten
5,067,660 A 11/1991 Reinhall
5,071,514 A 12/1991 Francis
5,081,039 A 1/1992 Buttke et al.
5,091,713 A 2/1992 Horne et al.
5,233,542 A 8/1993 Hohner et al.
5,425,508 A 6/1995 Chaney
5,445,328 A 8/1995 Musselman
5,491,340 A 2/1996 Saarinen
5,500,088 A 3/1996 Allison et al.
5,500,735 A 3/1996 Bentley et al.
5,544,819 A 8/1996 Shepherd
5,555,171 A 9/1996 Sonehara et al.
5,581,019 A 12/1996 Minor et al.
5,586,305 A 12/1996 Eidson et al.
5,600,058 A 2/1997 Preikschat et al.
5,601,690 A 2/1997 Gauld et al.
5,638,284 A 6/1997 Helmer et al.
5,666,493 A 9/1997 Wojcik et al.
5,680,320 A 10/1997 Helmer et al.
5,682,473 A 10/1997 Carson et al.
5,684,247 A 11/1997 Preikschat
5,687,098 A 11/1997 Grumstrup et al.
5,691,636 A 11/1997 Allshouse et al.
5,718,389 A 2/1998 Finken et al.
5,745,365 A 4/1998 Parker
5,747,707 A 5/1998 Johansson et al.
5,758,329 A 5/1998 Wojcik et al.
5,823,453 A 10/1998 Garasimowicz
5,825,653 A 10/1998 Huovila et al.
5,966,679 A 10/1999 Snowbarger et al.
5,975,438 A 11/1999 Garasimowicz
5,991,636 A 11/1999 Won et al.
6,024,309 A 2/2000 Karlstrom
6,092,003 A 7/2000 Hagart-Alexander et al.
D431,826 S 10/2000 Karlstrom
6,157,916 A 12/2000 Hoffman
6,200,421 B1 3/2001 Meinander
6,206,309 B1 3/2001 Danielsson et al.
6,290,816 B1 9/2001 Graf
6,314,381 B1 11/2001 Johansson
6,317,701 B1 11/2001 Pyotsia et al.
6,324,490 B1 11/2001 Johansson et al.
6,502,774 B1 * 1/2003 Johansson et al. ..... 241/37
6,587,803 B1 7/2003 Johansson
6,892,973 B1 * 5/2005 Johansson et al. ..... 241/261.2
6,915,711 B1 * 7/2005 Backlund et al. ..... 73/862.391
2001/0032898 A1 10/2001 Bankes et al.
2002/0013635 A1 1/2002 Gotou et al.

FOREIGN PATENT DOCUMENTS

DE 2145096 1/1973
EP 0640395 3/1995
GB 1468649 3/1977
WO WO 83/01969 6/1983
WO WO 89/00624 1/1989
WO WO 96/14156 5/1996
WO WO 97/23018 6/1997
WO WO 97/24596 7/1997
WO WO 97/38792 10/1997
WO WO 98/48936 11/1998
WO WO 98/58243 12/1998

OTHER PUBLICATIONS

K.B. Miles and W.D. May, Pulp and Paper Research Institute of Canada, Predicting the Performance of a Chip Refiner; A Constitutive Approach, 1991 International Mechanical Pulping Conference, pp. 295-301.

H.R. Dana, W.D. May, K.B. Miles and B.G. Newman, Pulp and Paper Research Institute of Canada, Pointe Claire, P.Q., A Study of Steam Flow and Self-Pressurization in Chip Refiners, Transactions, vol. 1, No. 3, Sep. 1975, pp. 82-88.

K.B. Miles and W.D. May, Pulp and Paper Research Institute of Canada 1989 Annual Meeting, The Flow of Pulp in Chip Refiners, pp. A177-A188.

William Herbert and P.G. Marsh, Mechanics and Fluid Dynamics of a Disk Refiner, Tappi, vol. 51, No. 5, May 1968, pp. 235-239.

A Master's thesis by Alexander Horch, Modeling and Control of a Thermo Mechanical Pulp Refiner, Dec. 7, 1995.

Helmut Becker, Hans Hoglund and Goran Tistad, Frequency and temperature in chip refining, Paperi ja Puu-Papper och Tra, No. 3, 1977.

D. Atack and M.I. Stationwala, Pulp and Paper Research Institute of Canada, On the Measurement of Temperature and Pressure in the Refining Zone of an Open Discharge Refiner, Transactions, vol. 1, No. 3, pp. 71-76, Sep. 1975.

Esko Harkonen, Seppo Routtu, Ari Ruotu and Ola Johansson, A Theoretical Model for a TMP-Refiner, Jun. 9-13, 1997, pp. 95-102, 1997 International Pulping Conference, Stockholm, Sweden.

B.G. Newman, M.I. Stationwala and D. Atack, Pulp and Paper Research Institute of Canada, Analysis of Steam Flow in Disc Refining, SPCI International Mechanical Pulping Conference, May 6-10, 1985, pp. 60-67.

Per A. Gradin, Ola Johansson, Jan-Erik Berg and Staffan Systrom, Measurement of the Power Distribution in a Single Disc Refiner, J. Pulp Paper Science 25, No. 11: 384-387 (1999).

M.I. Stationwala, D. Atack, J.R. Wood, D.J. Wild, and A. Karnis, Pulp and Paper Research Institute of Canada, The Effect of Control Variables on Refining Zone Conditions and Pulp Properties, Pap. Puu 73, No. 1: 62-69 (Jan. 1991).

Marc. J. Sabourin, Eric Xu, J. Brad Cort, Ivan Boileau and Andrew Waller, Optimizing Residence Time, Temperature and Speed to Improve TMP Pulp Properties and Reduce Energy, Pulp Pap. Can. 98, No. 4: 38-45, Apr. 1997.

K.B. Miles, H.R. Dana and W. D. May, The Flow of Steam in Chip Refiners, CCPA Conf. Technol. E. Stivale 55-60 (Jun. 2-5, 1982), pp. 30-42.

Ola Johansson, Mark Frith, Bo Falk and Robert Gareau, Thermopulp® —Recent Process Developments and Experiences, 84th Annual Meeting of the Technical Section of the CCPA; Papers Presented Jan. 29-30, 1998, pp. 1-11.

OMEGA Thermocouple of Calibrator Handbook (1996).

Ali P. Haapanen, Pulp and Paper Technical Association of Canada 86th Annual Meeting Papers (2000), On-Line Temperature Measurement for Paper Machine Dryers: A New Way to Monitor and Improve Performance, pp. B81-B84.

83rd Annual Meeting, Technical Section, Canadian Pulp & Paper Association, Papers Presented on Tuesday and Wednesday, Jan. 28-29, 1997, Preprints A, Electronic Customer Data Management System, pp. A53-A56.

OMEGADYNE™ Pressure, Force, Load Torque Databook (1996), Chapters B, C, D, E, F, G, H, and J.

Bill Gough, John Kay, and Greg Seebach, Canadian Pulp & Paper Association, Technical Section, 79th Annual meeting, Preprints A, Adaptive Control Applications in Pulp and Paper, pp. A73-A84, Jan. 26-27, 1993.

Luc Charbonneau and Philip Plouffe, Canadian Pulp & Paper Association, Technical Section, 79th Annual Meeting, Preprints A, Sensodec-10-Condition Monitoring System, pp. A109-A118, Jan. 26-27, 1993.

M. Spence, K. Danielson, Y.Ying, and M. Rao, Canadian Pulp & Paper Association, Technical Section, 79th Annual Meeting, Preprints A, On-Line Advisory Expert Development at Daishowa Peace River Pulp, pp. A143-A147, Jan. 26-27, 1993.

Geoff Lawrence, Canadian Pulp & Paper Association, Technical Section, 79th Annual Meeting, Preprints A, New Measurement and Control System Allows for Simple and Economical DCS Integration, pp. A179-A183, Jan. 26-27, 1993.

James J. Pint and Pierre Gingras, Canadian Pulp & Paper Association, Technical Section, 79th Annual Meeting, Preprints A, "Truly" Distributed Control Systems—Through Intelligent, Networked I/O, pp. A291-A294, Jan. 26-27, 1993.

John R. Lavigne, Pulp and Paper Industry Division, An Introduction to Paper Industry Instrumentation, Revised Edition, 1977, Chapters 1, 2, 4, 5, 6, 7, 8, 10, 11, 12, 15, 16, 17, 18,19, and 20.

B.C. Strand and Anders Mokvist, 1991 Int'l Mech. Pulping Conf. Proc., Jun. 2-5, On-Line Control and Optimization of the Refining Process Using a Model Based Control System, pp. 101-108.

Jan Hill, Kari Saarinen, and Roger Strenros, 1991 Int'l Mech. Pulping Conf. Proc., Jun. 2-5, On the control of chip refining systems, pp. 235.241.

Kenneth W. Britt, Ed., Handbook of Pulp and Paper Technology, 2nd Ed. (1970), Chapter 5.

M. Fournier, H. Ma, P.M. Shallhorn, and A.A. Roche, Control of Chip Refiner Operation, 1991 Int'l Mech. Pulping Conf. Proc., pp. 91-100.

Daniel Jutras, Steve A. Rowland, Luis Cortez, and Nelson Lafleur, The Hymac HXD-64: A New Concept in Refiner Design, 1991 Int'l Mech. Pulping Conf. Proc., pp. 285-294.

M.I. Stationwala, K.B. Miles, and A. Karnis, The Effect of First Stage Refining Conditions of Pulp Properties and Energy Consumption, 1991 Int'l Mech. Pulping Conf. Proc., pp. 321.327.

Art. Jepson, New Wave Screen Baskets Upgrade Existing Systems, 1984 Pulping Conf. TAPPI Proc., pp. 515-520.

OMEGA, CO1, CO2, CO3 "Cement-On" Thermocouples User's Guide (1996).

Lars Johansson, Effects of Temperature and Sulfonation of Deformation of Spruce Wood, Thesis for Dept. of Forest Prods. And Chem. Eng'g, Chalmers University of Technology, Goteborg, Sweden (1997).

OMEGA Transactions in Measurement and Control, vol. 3: Force-Related Measurements (1998).

Karen Eriksson, Performance Analysis in TMP Refining, Thesis for Dept. of Signals and Systems, Chalmers University of Technology, Goteberg, Sweden (2001).

BeInZero AB Refiner Control System documentation, "Get to Know Your Refiners" , p. 1-19 and appendices 1 and 2 (2000).

Jan Sundholm, Papermaking Science and Technology, Book 5: Mechanical Pulping (1999), chapters 1-4 and 7-10.

Lydia Bley and Roland Berger, Recent Advances in On-Line Charge Measurements, 2001 Int'l Mech. Pulping Conf. Proc, pp. 63-72.

Francois Julien Saint Amand and Bernard Perrin, Fundamental Aspects of Mechanical Pulp Screening, 2001 Int'l Mech. Pulping conf. Proc, pp. 387-406.

B.C. Strand, View on Control Development, 2001 Int'l Mech. Pulping Conf. Proc., pp. 477-480.

Karl Mosbye, Kjell-Arve Kure, Guri Fuglem, Ola Johansson, Use of Refining Zone Temperature Measurements for Refiner Control, 2001 Int'l Mech. Pulping Conf. Proc., pp. 481-488.

Olof Ferritsius and Rita Ferritsius, Experiences from Stora Enso Mills of Using Factor Analysis for Control of Pulp and Paper Quality, 2001 Int'l Mech. Pulping Conf. Proc., pp. 495-503.

Juha Kortelainen, Anitti Salopuro, Jouko Halttunen, Prediction of TMP Quality Properites with On-Line Measurements, 2001 Int'l Mech. Pulping conf. Proc., pp. 505-512.

Ismo Joensuu, Lennart Karlsson, Jaakko Myllyneva, Fuzzy Quality Control of a TMP Plant, 2001 Int'l Mech. Pulping Conf. Proc., pp. 513-521.

Lars Sundstrom, Roy Tonnesen, and Lennart Nilsson, Multivariate Monitoring of a Chip Feeding Process, 2001 Int'l Mech. Pulping Conf. Proc., pp. 523-529.

Petteri Vuorio and Peter Bercquist, New Refiner Segments Technology to Optimize Fiber Quality and Energy Consumption of a Refiner Mechanical Pulp, 2001 Int'l Mech. Pulping Conf. Proc., pp. 565-577.

Ola Johansson, Dan Hogan, Dale Blankenship, Eddie Snow, Wyllys More, Ronnie Qualls, Keith Pugh, and Mike Wanderer, Improved Process Optimization Through Adjustable Refiner Plates, 2001 Int'l Mech. Pulping Conf. Proc., pp. 579-589.

Fredrik Rosenqvist, Karin Eriksson and Anders Kalstrom, Time-Variant Modelling of TMP Refining, undated.

Fredrik Rosenqvist, Karin Eriksson, and Anders Karlstrom, Modelling a Termomechanical Wood-Chip Refiner, undated.

Plant Information (PI™) system brochure, OSI Software Inc., undated.

J&L Fiber Services, J&L Smart Plates™ Selling Training Class to help you "Take Control", Feb. 22, 2000.

I. Aarni and J. Virkkunen, Modelling and Simulation of the Thermomechanical Pulping Process, IFAC PRP Automation, Ghent, Belgium 1980, pp. 219-226.

M. Press and A.S. Arrott, An Analysis of Steam Flow In A Chip Refiner, Can. J. Phys. vol. 57, 1979, pp. 390-396.

* cited by examiner

REFINER SENSOR AND COUPLING ARRANGEMENT

FIELD OF THE INVENTION

The present invention relates to a sensor assembly and coupling arrangement therefor for use in pulp processing equipment and more particularly to a sensor assembly and coupling arrangement therefor for a pulp processing refiner.

BACKGROUND OF THE INVENTION

Many products we use everyday are made from fibers. Examples of just a few of these products include paper, personal hygiene products, diapers, plates, containers, and packaging. Making products from wood fiber, fabric fiber and the like, involves breaking solid matter into fibrous matter. This also involves processing the fibrous matter into individual fibers that become fibrillated or frayed so they more tightly mesh with each other to form a finished fiber product that is desirably strong, tough, and resilient.

In fiber product manufacturing, refiners are devices used to process the fibrous matter, such as wood chips, fabric, and other types of pulp, into fibers and to further fibrillate existing fibers. The fibrous matter is transported in liquid stock to each refiner using a feed screw driven by a motor.

Each refiner has at least one pair of circular ridged refiner disks that face each other. During refining, fibrous matter in the stock to be refined is introduced into a gap between the disks that usually is quite small. Relative rotation between the disks during operation fibrillates or grinds fibers in the stock as the stock passes radially outwardly between the disks.

One example of a refiner that is a disk refiner is shown and disclosed in U.S. Pat. No. 5,425,508. However, many different kinds of refiners are in use today. For example, there are counterrotating refiners, double disk or twin refiners, and conical disk refiners. Conical disk refiners are often referred to in the industry as CD refiners.

During operation, many refiner parameters are monitored. Examples of parameters include the power of the motor coupled to a rotor carrying at least one refiner disk, the mass flow rate of the stock slurry being introduced into the refiner, the force with which opposed refiner disks are being forced together, the flow rate of dilution water being added in the refiner to the slurry, and the refiner gap.

It has always been a goal to monitor conditions in the refining zone between the pairs of opposed refining disks. However, this has always been a problem because the conditions in the refining zone are rather extreme making it rather difficult to accurately measure parameters in the refining zone, such as temperature and pressure.

Sensors have been used in the past to monitor parameters relating to refiner operation that include, for example, consistency, stock pressure, stock temperature, dilution flow water rate, refiner gap, the pressure or force urging one refiner disc toward the other, refiner energy use, and other parameters. Most of the sensors employed to measure these parameters were not located in the refining zone. As a result, while useful information was obtained to help make refiner control decisions, there was often a time lag that occurred from the time that changes actually occurred in the refining zone to when the sensor or sensors monitoring one or more of the parameters detected a change. This often lead to an operator of the refiner or an automatic refiner control system making a change to a refiner control parameter, such as refiner gap, dilution water flow rate, chip mass flow rate, refiner disc pressure or force, or refiner disc best because it may not have been truly based upon actual conditions in the refiner zone. As a result, refiner process control changes are typically infrequently made so as to permit operation of the refiner to converge or settle to a steady state operating condition. Often, this takes a great deal of time, typically hours, for it to be determined whether the change made by the operator of the automatic refiner control system had the desire effect. If it did not, it is possible that the quality of the resultant fiber product ultimately produced may not meet quality control standards. When this happens, the fiber product may have to be scrapped or sold at reduced cost. For example, where the fiber product is paper, this time lag can cause the fiber that is outputted by the refiner to have a lower quality than desired. This can cause paper made with the fiber to fail to meet quality control criteria for strength or some other parameter. When this happens, the paper may be scrapped by putting it into a beater so it can be reused to make other paper or it is sold at a reduced price as job lot. More recently, attempts have been made to locate sensors in close proximity to the refiner zone. For example, U.S. Pat. No. 6,502,774 discloses a plurality of spaced apart bores in the refining surface of a refiner disc. Temperature sensors are disposed in the bores such that the sensing element is located below the bottom of an adjacent groove of the disc in which it is disposed. While this sensor assembly is capable of outputting a temperature measurement, the measurement outputted may not accurately reflect the temperature of stock in the refining zone. First, since the sensing element is located below the bottom of an adjacent groove, it can measure the temperature of the material of the refiner disc that surrounds the sensor assembly. Since refiner discs are typically made of metal and possess a considerable amount of mass, the temperature of material often differs, sometimes quite significantly, from the temperature of stock in the refining zone. As a result, temperature response is quite slow and not indicative of the actual temperature of stock in the refining zone.

Such sensor arrangements have been used in the past, but have not been satisfactory because of the effects of thermal inertia caused by the surrounding mass of the refiner disc. Refiner control systems that receive temperature data from such sensors, are not as effective in controlling refiner operation because of this inherent time lag. Due in part to this, the performance of these control systems has been less than optimal, leaving a great deal of room for improvement.

The reliability and robustness of sensor assemblies has also been an issue because of the rather harsh conditions to which they are exposed in the refining zone. They are subjected to vibration, shock, temperature fluctuations, and pressure fluctuations that all can occur during refiner operation. Any one of these things can cause sensor failure or a significant degradation in sensor performance. Where a sensor is part of an array or group of sensors mounted to a refiner disc or in between refiner discs, the loss or degradation in performance of just a single sensor can have a significant impact. One known problem that exists for temperature sensors is that the sensing element holder can loosen over time and get pushed axially into the refining disc in which it is disposed. When this happens, the steam tight seal between the sensor assembly and the refiner disc can be compromised thereby causing steam and stock to leak from the refining zone through the bore in the refining surface completely through the disc. Such a leak can lower the pressure in the refining zone, which can reduce refining efficiency, quality, and throughput. Worse yet, stock and steam leaking from damaged sensor as well as other sensors that have not been damaged. This ultimately can lead to failure of the entire array or group of sensors, effectively rendering the refiner control system inoperative. Where leakage becomes too great, production will have to be stopped to change the sensor refiner disc. When such down time is unplanned, it is particularly costly.

What is needed is a more reliable and robust sensor assembly that is better able to withstand vibration, impact, shock, pressure fluctuations, and temperature fluctuations during refiner operation while still being able to provide a temperature measurement that is representative of a temperature of stock in the refining zone. What is also needed is a sensor refiner assembly that minimizes effects caused by leakage of stock and steam from the refining zone should a leak develop through one of the sensor assembly receiving bores in the refining surface of a sensor refiner disc.

SUMMARY OF THE INVENTION

The invention is directed to a sensor assembly and arrangement for steam-tightly conveying the sensor assembly wiring to a location of the refiner where signals transmitted by the wiring can be processed or further conveyed to a location where the signals can be processed. As a result, sensor assembly reliability and robustness is improved and sensor assembly failure is prevented by steam-tightly shielding the sensor assembly and its wiring from stock and steam in the refining zone of the refiner in which the arrangement is disposed.

The sensor assembly includes a housing defined by a tubular base to which a frustoconical cap is attached. The cap has a flat from which a sensing element bulb protrudes. Preferably, a sensing element of the sensor assembly is disposed inside the housing in contact with the bulb. The base preferably is threaded and threadably receives the cap. A bonding agent, such as epoxy or the like, can be used to fix the cap to the base.

The bulb is disposed in a pocket in the refining surface of a sensor refiner disk segment that carries the sensor assembly. Preferably, the sensor refiner disk segment carries a plurality of sensor assemblies, each disposed in their own pocket. The threaded base preferably is threadably received by a sensor carrier that preferably is a hollow manifold in which the sensor wiring is disposed.

The sensor wiring is threaded out a fixture attached to the manifold and through a flexible reinforced hose until the wiring is received in a sensor connector. The manifold is mounted to the backside of the sensor refiner disk segment. The flexible reinforced hose preferably has a braided exterior that preferably is made of stainless steel or another tough and durable material. The hose preferably includes a liner in which the sensor wiring is disposed that helps shield the wiring from the harsh environment within the refiner.

The sensor carrier preferably comprises a puck that has a base that is mounted to the refiner disk segment that is adjacent to the sensor refiner disk segment. The base of the puck includes a pedestal that carries a seal that steam-tightly seals with a portion of one of the instrument ports. The pedestal carries a connector body that has a threaded exterior and which houses a female electrical connector having enough connector pin-receiving sleeves to enable all of the sensor signals to be transmitted.

The puck is mounted so as to position the electrical connector generally in line with the instrument ports such that a conduit arrangement can sealingly engage the puck. The conduit arrangement includes a section of outer conduit that is received in the instrument ports and which engages the puck. The conduit arrangement also includes a tube received in the outer conduit that carries a male electrical connector that mates with the female electrical connector when the conduit arrangement is inserted into the instrument ports and engaged with the puck. Preferably there is a seal disposed between the tube and outer conduit that prevents steam from passing therebetween.

The outer conduit preferably threadably engages the puck and a portion of the instrument port that is located adjacent the puck. The tube is held captive within the conduit with its electrical connector coupled with the electrical connector of the puck. An anchor nut that is threadably received adjacent the opposite end of the conduit bears against a shoulder of the tube to help keep the tube captive within the conduit such that its connector remains coupled with the connector of the puck when the conduit is threadably engaged with either the instrument port, the puck connector body, or both. The free end of the tube preferably is sealed by a cap that retains a sealing plug through which sensor wiring passes to the exterior of the conduit arrangement.

Objects, features, and advantages of the present invention include a sensor that is capable of sensing a parameter or characteristic of conditions in the refining zone; that is robust as it is capable of withstanding severe vibration, heat, pressure and chemicals; is capable of repeatable, accurate absolute measurement of the refining zone characteristic or parameter; is simple, flexible, reliable, and long lasting, and which is of economical manufacture and is easy to assemble, install, and use.

Other objects, features, and advantages of the present invention includes a conduit arrangement that enables sensor wiring to be routed to the exterior of the refiner while preventing steam from escaping from the refining zone; a conduit arrangement that is steam tight; is formed using a minimum of machining steps, time and components; can be devised for any rotary disk refiner; is capable of being used in a refiner without modification of the refiner; and is simple, flexible, reliable, and robust, and which is of economical manufacture and is easy to assemble, install, and use.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF AT LEAST ONE PREFERRED EMBODIMENT

Figure 1:
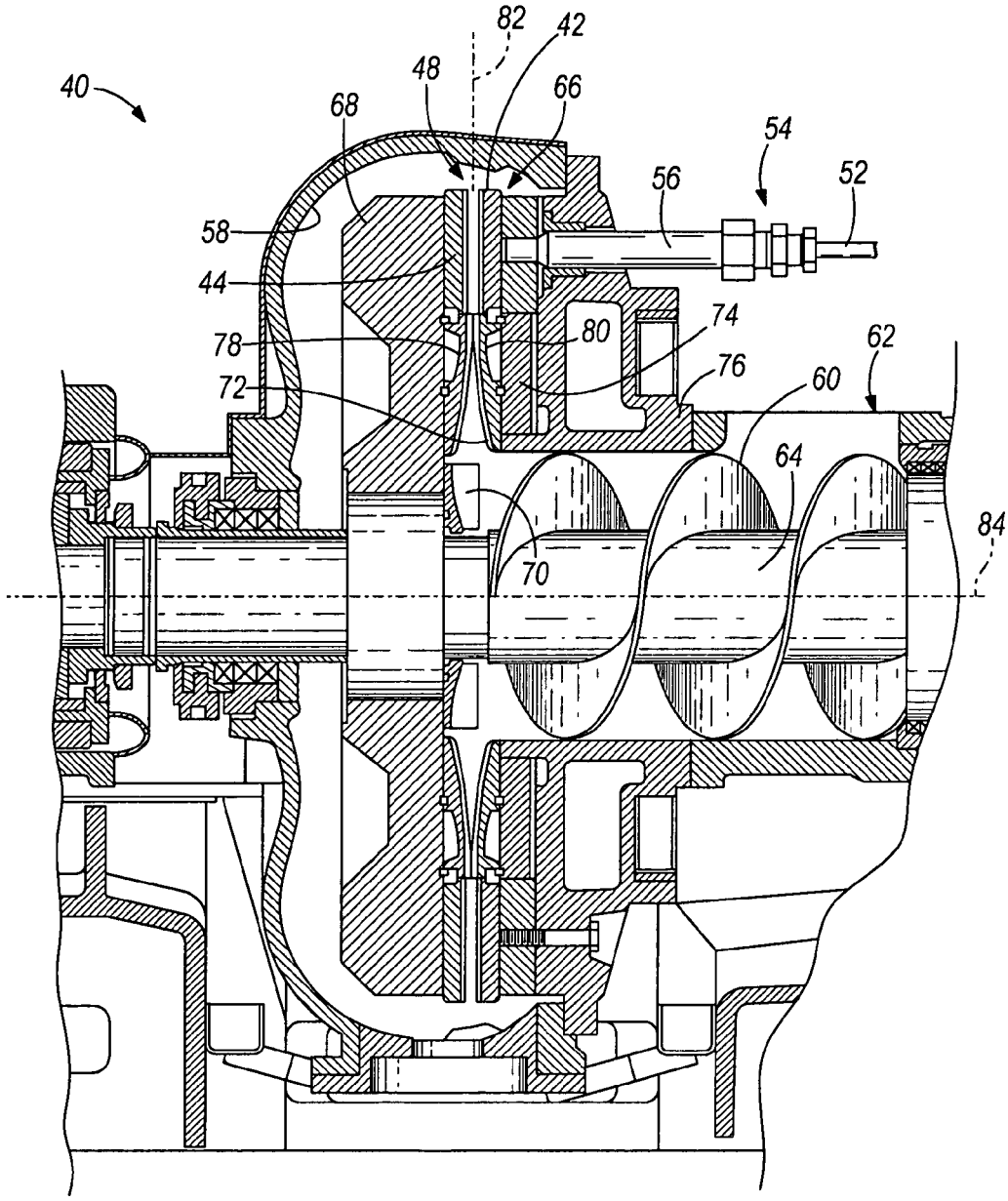
FIG. 1 is a fragmentary cross sectional view of a disk refiner equipped with a sensor refiner disk and coupling arrangement of the invention.
Figure 2:
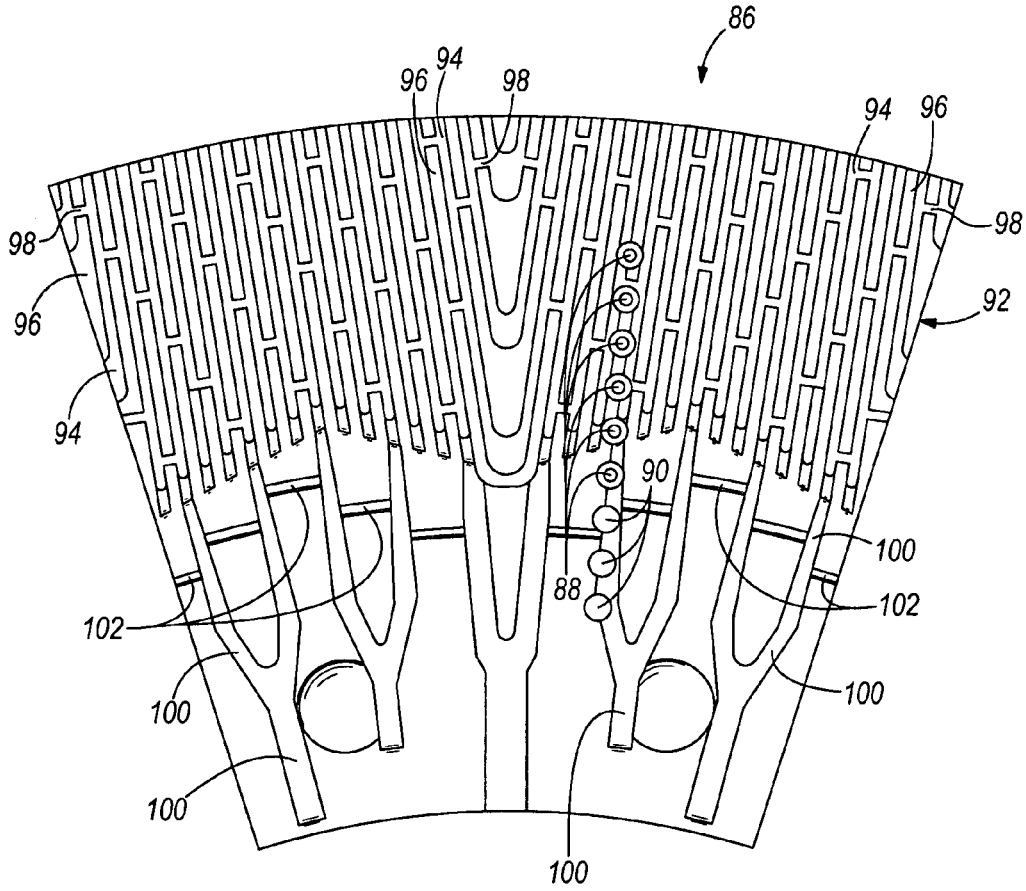
FIG. 2 is a front plan view of a sensor refiner disk segment.
Figure 3:
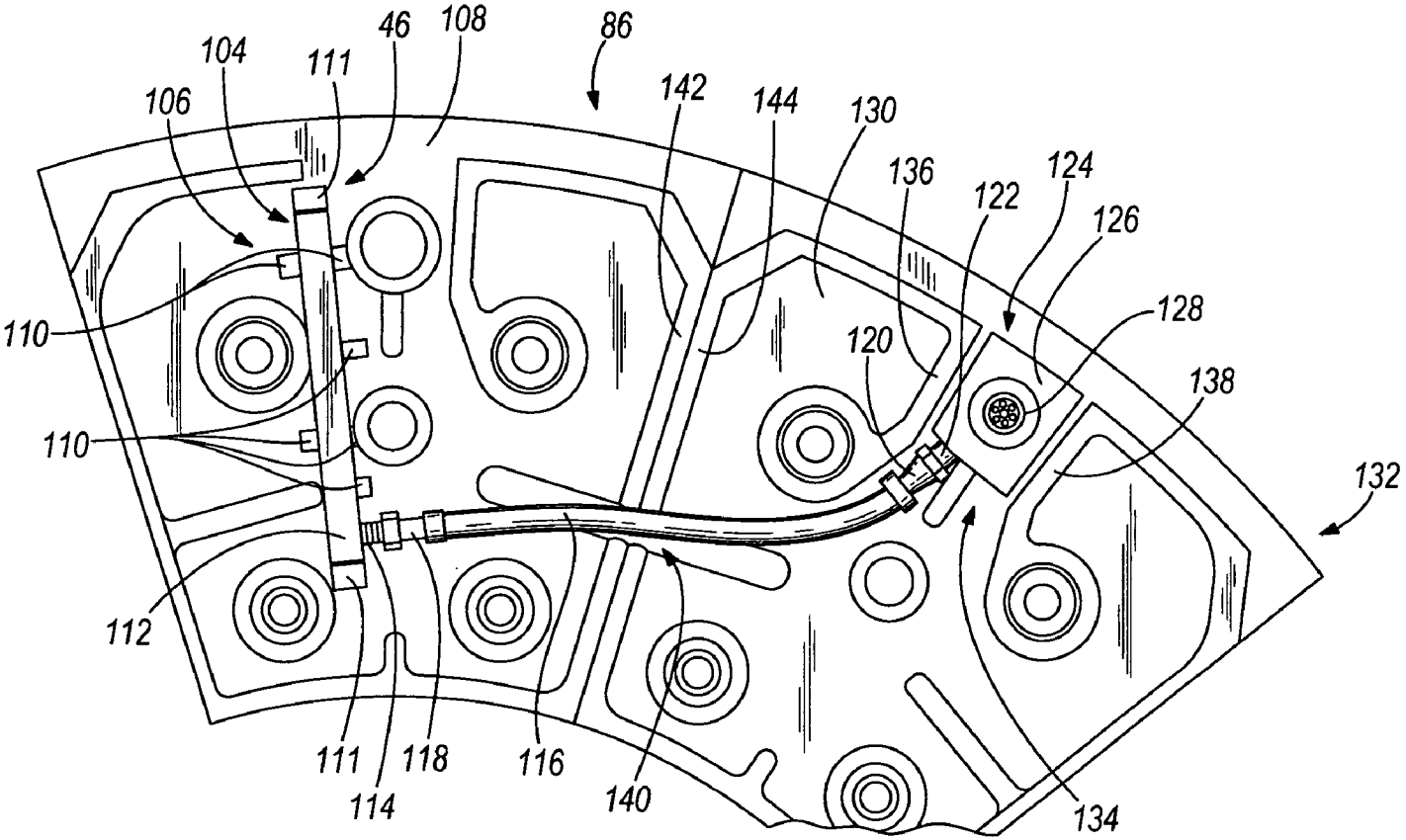
FIG. 3 is rear plan view of the sensor refiner disk segment and an adjacent segment.

FIGS. 1–3 illustrate a refiner 40 that has a plurality of opposed refiner disks 42, 44, one of which carries a sensor arrangement 46 (FIG. 3) that is used to sense a parameter in a refining zone 48 located between the disks during refiner operation. The sensor arrangement 46 includes a plurality of sensor assemblies 50, each of which has a portion exposed to the refining zone 48 such that it contacts stock in the refining zone 48 during refiner operation. Sensor wiring 52 is received in a steam-tight conduit arrangement 54 that includes a section of conduit 56 that extends through a pre-existing instrument port in the refiner 40.

The refiner 40 has a housing or casing 58 and an auger 60 mounted therein which urges stock, typically in the form of a slurry of liquid and fiber, introduced through a stock inlet 62 into the refiner. The auger 60 is carried by a shaft 64 that is rotated during refiner operation to help supply stock to an arrangement of treating structure 66 within the housing and a rotor 68. An annular flinger nut 70 lies generally in line with the auger 60 and directs stock propelled toward it by the auger 60 radially outwardly to a plurality of opposed sets of breaker bar segments, each of which is indicated by reference numeral 72 in FIG. 1.

Each set of breaker bar segments 72 preferably are in the form of sectors of an annulus, which together form an encircling section of breaker bars. One set of breaker bar segments is fixed to the rotor 68. The other set of breaker bar segments is fixed to another portion of the refiner 40, such as a stationary mounting surface 74, e.g. a stator, of the refiner or another rotor (not shown). The stationary mounting surface 74 can comprise a stationary part of the refiner frame 76 such as like that shown in FIG. 1.

Stock flows radially outwardly from the breaker bar segments 72 to a radially outwardly positioned first set of refiner disks 78 and 80. This set of refiner disks 78 and 80 preferably is removably mounted to a mounting surface. For example, one disk 78 is mounted to the rotor 68 and the other disk 80 is mounted to stationary mounting surface 74. The refiner preferably includes a second set of refiner disks 42 and 44 positioned radially outwardly of the first set of disks 78 and 80. Disk 44 is mounted to the rotor 68 and disk 42 is mounted to stationary mounting surface 74. These disks 42 and 44 preferably are also removably mounted. Each pair of disks 42, 44 and 78, 80 of each set is spaced apart so as to define a small gap between them that typically is between about 0.005 inches (0.127 mm) and about 0.125 inches (3.175 mm). The refining zone 48 is the space between the opposed refiner disks that is defined by this gap. Each disk can be of unitary construction or can be comprised of a plurality of segments.

The first set of refiner disks 78 and 80 is disposed generally parallel to a radially extending plane 82 that typically is generally perpendicular to an axis 84 of rotation of the auger 60. The second set of refiner disks 42 and 44 can also be disposed generally parallel to this same plane 82 in the exemplary manner shown in FIG. 1. This plane 82 passes through the refiner gap between each pair of opposed refiner disks 42, 44 and 78, 80. This plane 82 also passes through each space between the disks 42, 44 and 78, 80 that defines their respective refining zone 48. Depending on the configuration and type of refiner, one set of refiner disks can be oriented relative to another set of refiner disks such that their respective refining zones lie different planes (not shown).

During refiner operation, the rotor 68 and refiner disks 44 and 78 rotate about axis 84 causing relative rotation between the disks 42 and 44 and disks 78 and 80. Typically, the rotor 68 spins at a rotational speed of somewhere between about 400 and about 3,000 revolutions per minute. During operation, fiber in the stock slurry is refined, such as by being fibrillated, as it passes between the disks 42, 44 and 78, 80.

After passing between the refiner disks 42, 44 and 78, 80, the refined stock is discharged out an outlet of the refiner 40. The refined stock eventually makes its way to a moving web of a fiber processing machine, such as a paper making machine, where it forms a sheet.

The refiner 40 can be a refiner of the type used in thermomechanical pulping, refiner-mechanical pulping, chemithermomechanical pulping, or another type of pulping or fiber processing application. The refiner 40 can be a counterrotating refiner, a double disk or twin refiner, or a conical disk refiner known in the industry as a CD refiner.

FIG. 2 illustrates a segment of refiner disk 42 that is a refiner sensor disk segment 86 equipped with a plurality of radially spaced apart sensor assemblies 88 from which a stock temperature, a stock pressure, or a combination thereof can be obtained. In one preferred embodiment, the disk segment 86 is equipped with a plurality of pairs, i.e., at least three, of temperature sensor assemblies 88, each disposed in a pocket 90 formed in a refining surface 92 of the segment 42. In the sensor refiner disk segment 86 shown in FIG. 2, there are four such pockets 90 disposed in the refining surface 92 of the segment 86 and four such pockets 90 disposed radially inwardly of the refining surface 92.

The sensor refiner disk segment 86 is similar other disk segments that make up each annular refiner disk as the segment 86 has axially upraised refiner bars 94 that define grooves 96 between each pair of bars. In the preferred refiner disk segment embodiment shown in FIG. 2, radially extending refiner bars 94 have circumferentially extending connecting bars 98 that can be surface or subsurface dams. There also is a region of breaker bars 100 located radially inwardly of the region of the refiner bars 94. If desired, interconnecting bars 102 can extend between adjacent breaker bars 100.

Figure 4:
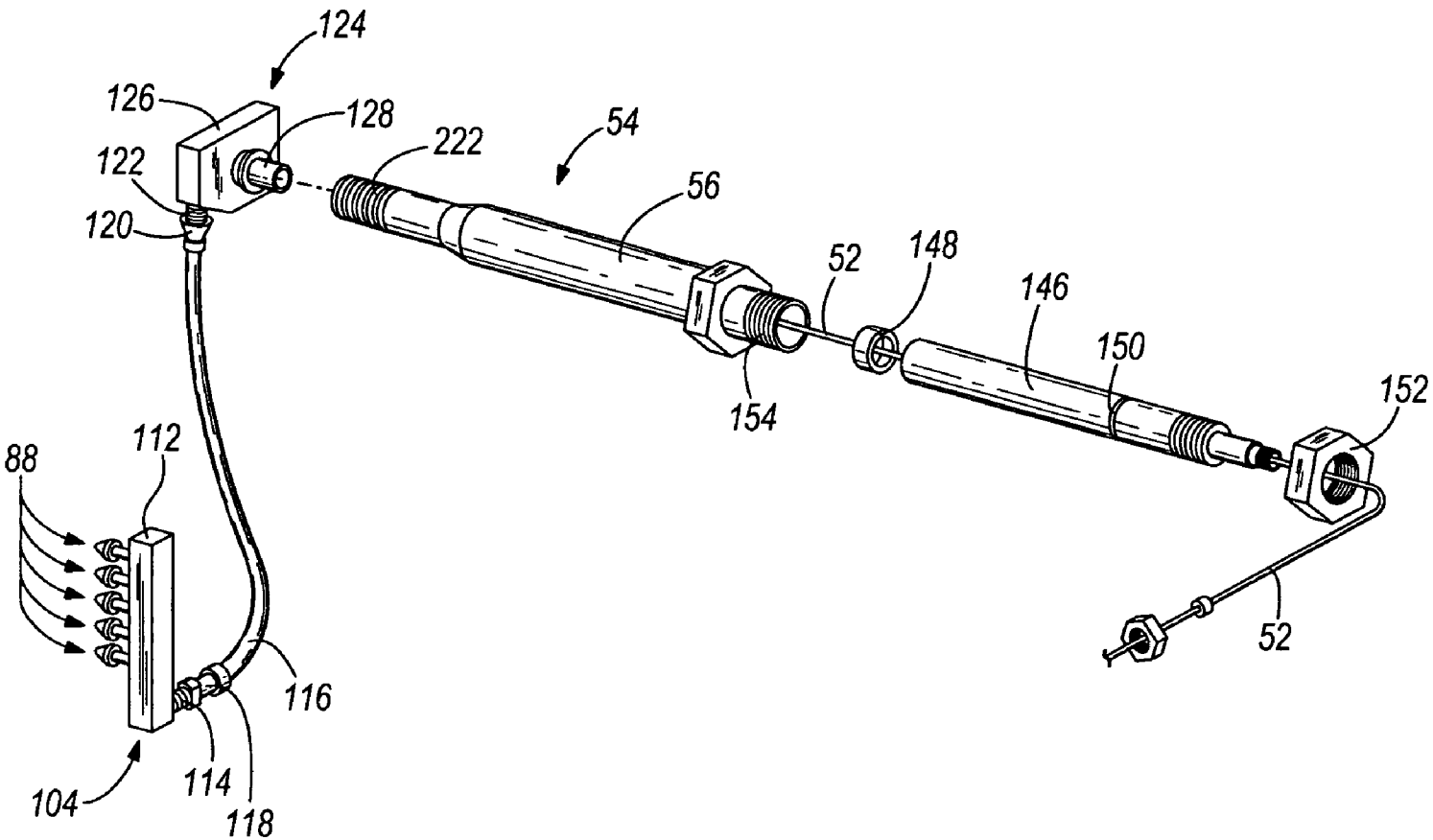
FIG. 4 is an exploded side view of a preferred embodiment of a plurality of sensor assemblies, manifold that holds the sensor assemblies, and coupling arrangement that housing cabling used to convey sensor signals out of the refiner.

Referring to FIGS. 3 and 4, the sensor arrangement 46 includes a sensor manifold 104 that holds each of the sensor assemblies 88 and maintains them in a spaced apart relationship such that a portion of each sensor assembly 88 is received in one of the pockets 90 formed in the sensor refiner disk segment 86. The sensor manifold 104 is received in a cradle 106 formed in a backside 108 of the sensor refiner disk segment 86. In the preferred embodiment shown in FIG. 3, the cradle 106 includes a plurality of radially spaced apart cradle fingers 110 that each has a slot (not shown) in which the sensor manifold 104 is received. The cradle further includes a pair of spaced apart abutments 111 with one abutment located at one end of the sensor manifold 104 and the other abutment located at the other end of the sensor manifold 104. The sensor manifold 104 is received in the cradle 106 and fixed to the backside 108 of the sensor refiner disk segment 86 such as by use of an epoxy, a high temperature potting compound, or another bonding agent. The sensor manifold 104 steam-tightly houses the sensor assemblies 88 and their associated sensor wiring 52 (FIG. 1) thereby providing protection to these sensitive components.

The sensor manifold 104 includes a housing 112 of square or rectangular cross section from which a fitting 114 extends outwardly therefrom adjacent one end. A flexible steam-tight hose 116 is attached at one end to the fitting 114 by a first coupling 118. The hose 116 has a second coupling 120 at its other end that is attached to another fitting 122 that extends outwardly from a connector puck 124. The hose 116 steam-tightly houses and shields the sensor wiring from the rather harsh environment within the refiner 40.

Referring to FIGS. 1, 3 and 4, the connector puck 124 includes a base 126 and a connector 128 that extends outwardly from the base 126. The puck 124 is fixed to the backside 130 of an adjacent refiner disk segment 132 that is modified to provide a puck cradle 134. Although not clearly shown in FIG. 3, the puck cradle 134 is a pocket located between two adjacent abutments 136, 138 between which the puck base 126 is received. Epoxy, potting compound, or another bonding agent preferably is used to fix the puck base 126 to the backside 130 of the refiner disk segment 132. The hose 116 is received in a channel 140 formed in each adjacent upright side edge 142 and 144 of the adjacent segments 86 and 132.

Referring more particularly to FIG. 4, the connector 128 sealingly receives a complementary connector (not shown) that is housed in the conduit arrangement 54. The conduit arrangement 54 includes a section of rigid conduit 56 that slidably, telescopically receives a section of rigid tubing 146 within which the sensor wiring 52 is steam-tightly housed. The section of rigid tubing 146 preferably is steam-tightly received in the conduit 56. To help provide a steam tight seal therebetween, the conduit arrangement 54 includes a coupling donut 148 and one or more sealing O-rings 150. The conduit 56 and tubing 146 are disposed in a port that extends through a side of the refiner 40 such that a portion of it projects outwardly from the refiner 40, such as in the manner depicted in FIG. 1. The port preferably is a preexisting instrument port. An anchor nut 152 that is received on a threaded portion 154 of conduit 56 preferably holds the conduit 56 and the tubing 146 together and can be used to anchor the conduit arrangement 54 to the refiner 40.

Figure 5:
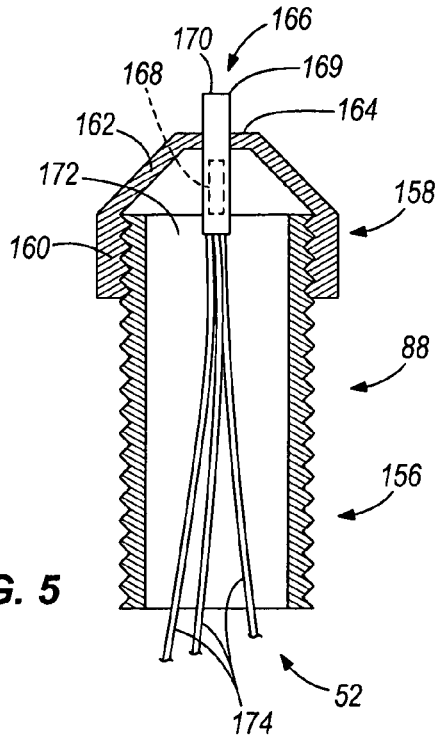
FIG. 5 is an enlarged partial fragment cross sectional view of a preferred sensor assembly embodiment.

FIG. 5 illustrates a preferred sensor assembly 88 in more detail. The sensor assembly 88 has a base 156 that preferably is externally threaded and a cap 158 that threads onto the base 156. The base 156 preferably is a threaded fitting that threads into a complementarily threaded bore (not shown in FIG. 5) in the sensor manifold 104. The cap 158 has a skirt 160 that is internally threaded so as to thread onto the external threads of the base 156 in the manner depicted in FIG. 5. The cap 158 also has a frustoconical nose 162 that extends upwardly from the skirt 160 and terminates in a flat 164 at its free end. A bulb 166 extends upwardly from the flat 164 and houses a sensing element 168 (shown in phantom) therein. Although the bulb 166 is shown in FIG. 5 with a squared off tip 169, the bulb 166 can also be constructed with a rounded tip.

In the preferred embodiment shown in FIG. 5, the bulb 166 is a tube 170 that extends downwardly into an interior chamber 172 of the sensor assembly 88. The tube 170 has an opening located in the chamber 172 through which the sensing element 168 is inserted. The sensing element 168 preferably is bonded to an interior surface of the tube 170, such as by using epoxy or another adhesive. Where the sensing element 168 is a pressure sensing element, the tip 169 of the bulb 166 has an opening (not shown) in it to expose the pressure sensing element to the atmosphere within in the refining zone. Where the sensing element 168 is a temperature sensing element, the tip of the bulb 166 is closed such that the base 156 and cap 158 prevent the sensing element 168 from coming into direct contact with the atmosphere within the refining zone. Such an atmosphere will undoubtedly include the stock being refined in the refining zone and steam that may have built up in the refining zone.

As is also shown in FIG. 5, the sensing element 168 has a plurality of wires 174 protruding from it that also extend into the sensor manifold 104. In the preferred embodiment depicted in FIG. 5, the sensing element 168 is a three wire RTD temperature sensing element that preferably is of platinum construction.

Figure 6:
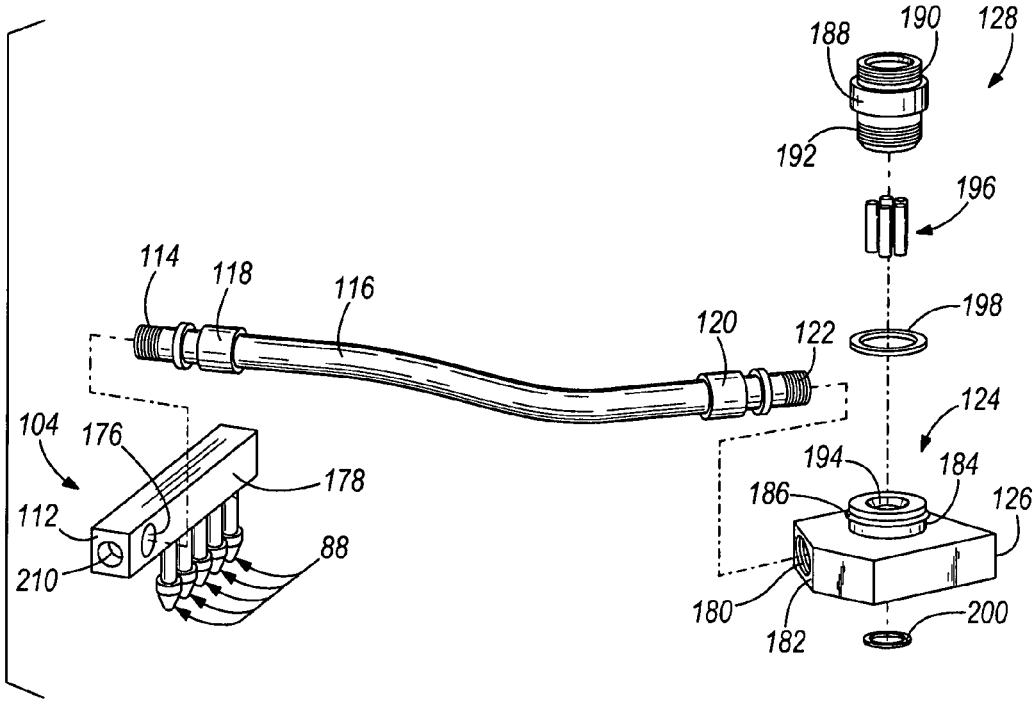
FIG. 6 is an exploded view of the sensor manifold, a sensor connector and flexible conduit that extends therebetween.
Figure 7:
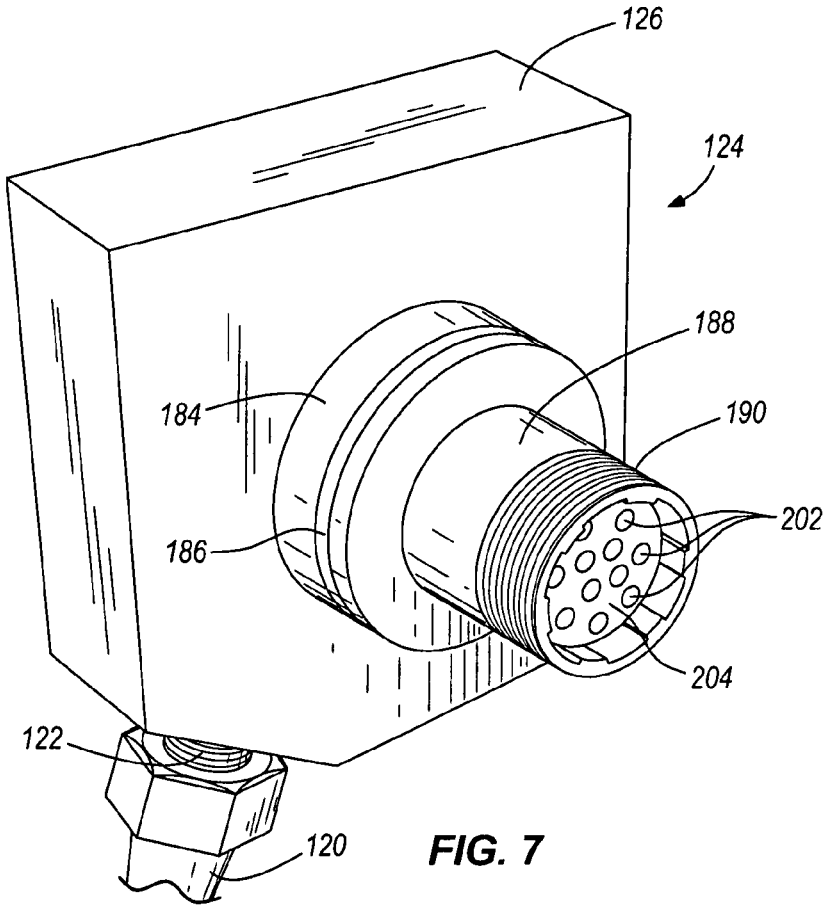
FIG. 7 is a cross sectional side view of another preferred sensor manifold embodiment that is mounted to a backside of a sensor refiner disk segment.

Referring additionally to FIGS. 6 and 7, the sensing element wiring 52 from each sensor assembly 88 is gathered in a hollow passageway (not shown) inside the sensor manifold 104, passes through a threaded port 176 in a side 178 of the manifold housing 112, is housed by the flexible hose 116, passes through a threaded port 180 in a side 182 of the puck base 126, and is attached to the connector 128 of the puck 124. The connector 128 is set upon a round pedestal 184 that is upraised from the body of the puck. The pedestal 184 carries a sealing O-ring 186 that bears against an inner surface of the conduit 56 or tube 146 when the conduit arrangement 54 is mounted on the connector 128. The connector 128 has a tubular body 188 that has an upper exteriorly threaded section 190 that threadably engages a complementarily interiorly threaded section (not shown) of the conduit 56 or tube 146 to prevent disconnection of the conduit arrangement 56 from the connector 128. As is shown more clearly in FIG. 6, the connector body 188 also has a lower exteriorly threaded section 192 that is threadably received in a threaded bore 194 in the puck pedestal 184.

The connector 128 also includes a plurality of pairs of electrically conductive terminal sleeves 196 that are held captive by a plurality of keepers 198 and 200 and the connector body 188, when the body 188 is attached to the puck pedestal 184. As is shown more clearly in FIG. 7, the connector body 188 has bores 202 formed in its outer face 204, each of which receives an electrically conductive pin (not shown) of the connector of the conduit arrangement 54 when the conduit arrangement 54 is mounted on the connector 128.

Figure 8:
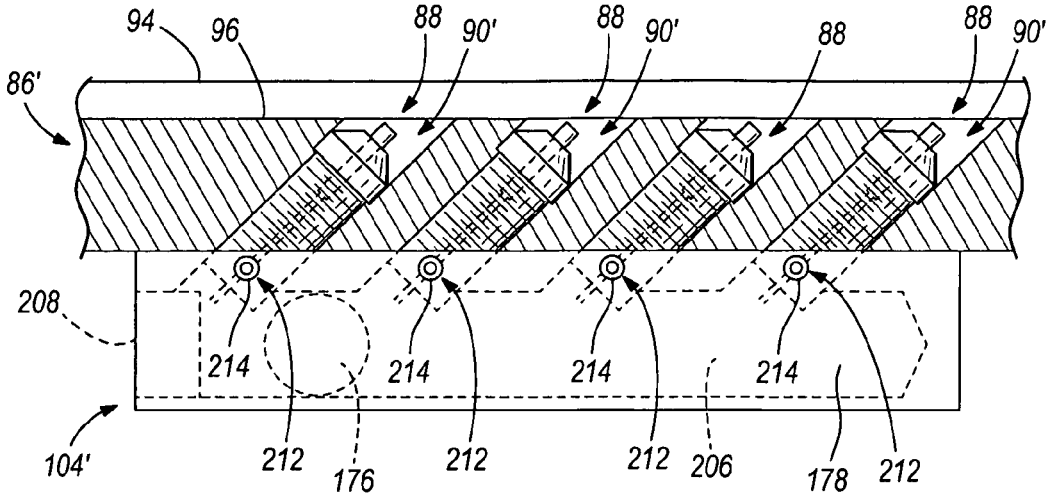
FIG. 8 is an enlarged perspective view of a preferred embodiment of the sensor connector.

FIG. 8 illustrates another preferred embodiment of sensor manifold 104'. The sensor manifold 104' is similar to sensor manifold 104 in that it includes a bore 206 (shown in phantom) that has an opening 208 at one end and has a length somewhat less than the length of the body of the manifold. The bore 206 preferably is threaded adjacent the opening 208 such that it threadably receives a plug 210 (FIG. 6) used to close and seal the opening 208.

The sensor manifold 104' is also similar to sensor manifold 104 in that it can include a sensor assembly anchor 212 that bears against each sensor assembly 88 to prevent its withdrawal. In the preferred embodiment shown in FIG. 8, each sensor assembly anchor 212 is a set screw 214 that is received in a threaded bore (not shown) in at least one side 178 of the manifold housing 112 that is threaded until it engages the base 156 of the sensor assembly 88. If desired, each sensor assembly 88 can be anchored from both sides in this manner.

The sensor manifold 104' shown in FIG. 8 differs from the sensor manifold 104 shown in FIGS. 4–6 in that it orients each sensor assembly 88 at an acute angle relative to the sensor manifold housing 112. As a result, each pocket 90' in the sensor refiner disk segment 86' in which a sensor assembly 88 is received is also oriented at such an angle, such as in the manner shown in FIG. 8.

Figure 9:
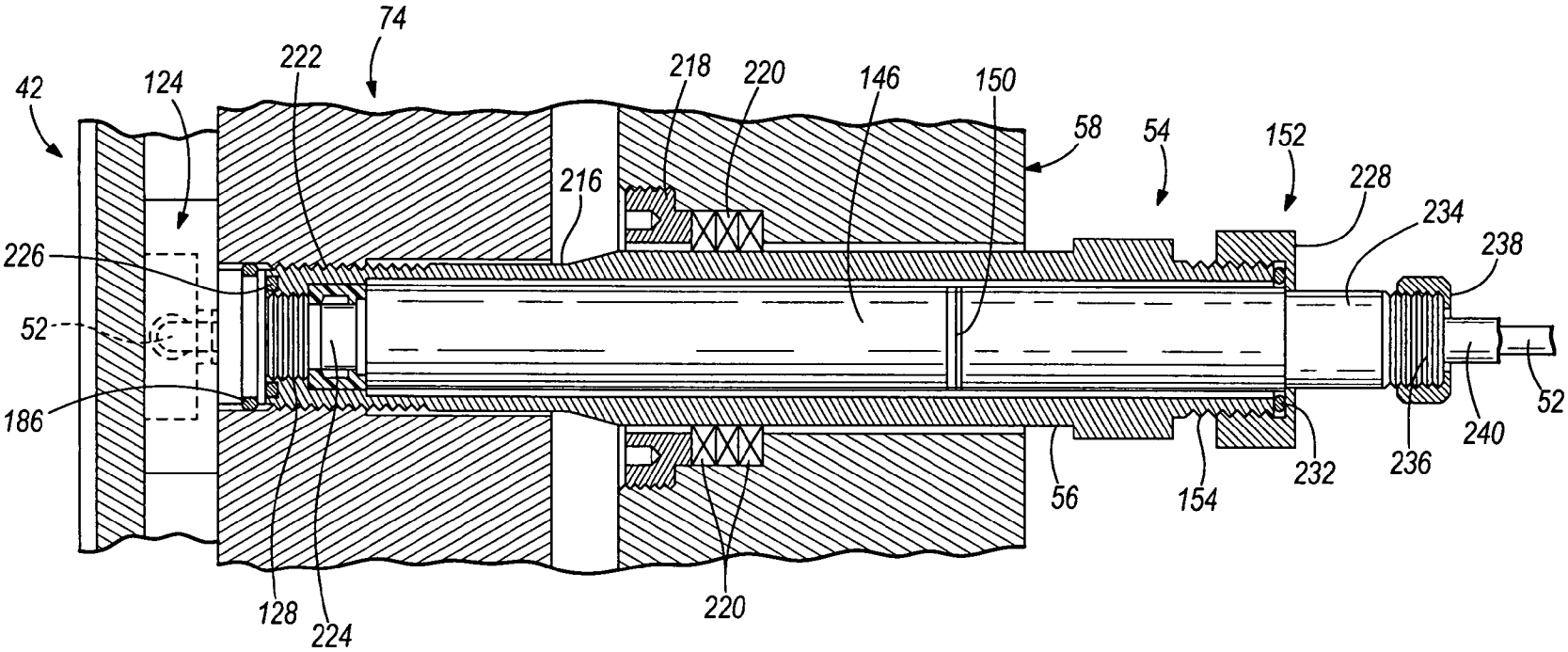
FIG. 9 is a fragmentary cross sectional view of a portion of the refiner showing a preferred embodiment of the coupling arrangement.

FIG. 9 illustrates the conduit arrangement 54 received in an instrument port that extends through part of the refiner housing 58 and that extends through part of the stationary refiner disk mounting surface 74. The outer conduit 56 has a diametrically necked down section 216 that is received in that portion of the instrument port that extends through the stationary refiner disk mounting surface 74. A sealing collar 218 is threadably disposed in a part of the instrument port of housing 58 to help facilitate a steam tight seal between the refiner housing 58 and the outer conduit 56. In the preferred embodiment shown in FIG. 9, the collar 218 bears against a plurality of bearings 220 that preferably also helps provide a seal between the outer conduit 56 and the refiner housing 58 while permitting the conduit 56 to rotate relative thereto to facilitate insertion and removal of the conduit arrangement 54.

The outer conduit 56 preferably has interior threads that threadably engage the outer threaded section 190 of the connector body 188 when the outer conduit 56 is mounted to the connector puck 124. To prevent steam from leaking into the conduit 56, an O-ring 226 is disposed between the axial end of the conduit 56 and the pedestal 184 of the puck 124. In the preferred embodiment shown in FIG. 9, the outer conduit 56 can be equipped with an exteriorly threaded section 222 such that it can be threaded into an interiorly threaded portion of the instrument port adjacent the puck 124.

The end of the inner tube 146 bears against the end of the connector body 188. The end of the tube 146 carries a male connector plug 224 that mates with the connector 128 of the connector puck 124 when the outer conduit 56 is disposed in contact with the connector body 188.

Adjacent the other end of the conduit arrangement 54, the anchor nut 152 is threaded onto the threaded portion 154 at the opposite end of the outer conduit 56. When threaded onto the conduit 56, an end wall 228 of the anchor nut 152 bears against a shoulder 230 of the inner tube 146 to keep the tube 146 immovably anchored within the outer conduit 56. The end wall 228 of the anchor nut 152 also sandwiches at least one and preferably a plurality of sealing disks 232 between it and the axial end of the conduit 56.

The inner tube 146 has diametrically necked down section 234 that extends outwardly beyond the anchor nut 152. The end of the inner tube 146 has a threaded portion 236 onto which an end cap 238 is threadably received. The end cap 238 has a tube 240 through which the sensor wiring 52 passes before it connects with a signal conditioner, computer, processor, computer network, or another electrical device (not shown) used to convey the sensor signals to a processor, such as a personal computer or the like, that processes them to obtain a temperature, pressure or combination of a temperature or pressure therefrom.

Figure 10:
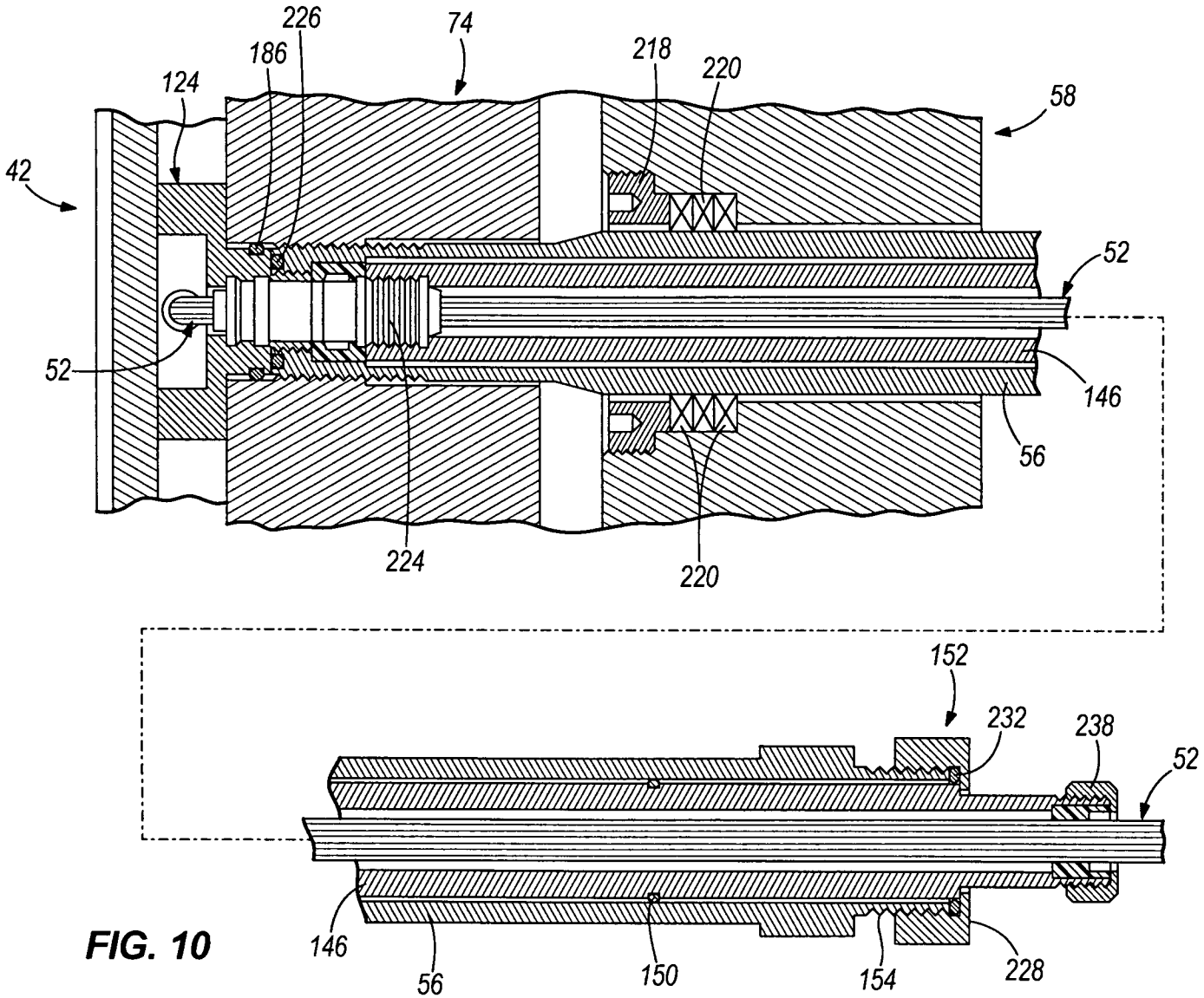
FIG. 10 is an enlarged fragmentary cross sectional view of a portion of the refiner showing the coupling arrangement in more detail.

FIG. 10 illustrates a conduit arrangement 54' of similar construction to that shown in FIG. 9. However, the conduit arrangement 54' differs in that the end of the outer conduit 56 that lies adjacent the connector puck 124 has both internal and external threads with the internal threads engaging the threads on the connector body and the external threads engaging the threaded section of that portion of the instrument port that extends through the stationary refiner disk mounting surface. The conduit arrangement 54' also differs in that end cap 238 captures a sealing end plug 242 when it is threaded onto the end of the inner tube 146.

It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A refiner for refining stock comprising:

a housing having an instrument port therein that is disposed adjacent an instrument port that extends through a stationary refiner disk holder to a refiner disk mounted to the disk holder with the refiner disk being comprised of a plurality of refiner disk segments that each have a refining surface defined by a plurality of refiner bars and grooves and a backside;

at least one sensor assembly disposed in a pocket in the refining surface of one of the refiner disk segments and having a plurality of sensor wires extending therefrom;

a sensor carrier carried disposed adjacent the backside of one of the refiner disk segments and housing the plurality of sensor wires;

a sensor connector disposed adjacent the backside of one of the refiner disk segments and having an electrical connector to which the plurality of sensor wires connect; and a conduit arrangement received in the instrument port of the refiner housing and the stationary refiner disk holder with the conduit arrangement housing an electrical connector that releasably couples with the electrical connector of the sensor connector.

2. The refiner of claim 1 wherein the sensor carrier is mounted to the backside of one of the refiner disk segments, the sensor connector is mounted to the backside of an adjacent one of the refiner disk segments, and further comprising a conduit that houses the plurality of sensor wires extending from the sensor carrier to the sensor connector.

3. The refiner of claim 2 wherein the sensor connector comprises a puck that has the electrical connector extending outwardly therefrom.

4. The refiner of claim 3 wherein the puck further comprises a pedestal that extends outwardly from a body of the puck and carries a seal, and wherein the electrical connector extends outwardly from the pedestal.

5. The refiner of claim 2 wherein there are a plurality of the sensors that are each fixed to the sensor carrier, and wherein the sensor carrier comprises a hollow manifold.

6. The refiner of claim 1 wherein the conduit arrangement comprises a rigid and tubular conduit that steam tightly engages the sensor connector.

7. The refiner of claim 1 wherein the conduit arrangement comprises a rigid and tubular outer conduit in which a tube is disposed in which sensor wiring housing is disposed.

8. The refiner of claim 1 wherein the sensor assembly comprises a tubular base, a frustoconical cap attached to the base with the frustoconical cap having a flat from which a sensing element bulb projects, and a sensing element carried by the sensor element bulb.

9. The refiner of claim 8 wherein the sensing element comprises a temperature sensing element.

10. The refiner of claim 8 wherein the sensing element comprises a pressure sensing element.

11. A refiner for refining stock comprising:

a housing having an instrument port therein that is disposed adjacent an instrument port that extends through a stationary refiner disk holder to a refiner disk mounted to the disk holder with the refiner disk being comprised of a plurality of refiner disk segments that each have a refining surface defined by a plurality of refiner bars and grooves and a backside;

at least one sensor assembly disposed in a pocket in the refining surface of one of the refiner disk segments and having a plurality of sensor wires extending therefrom;

a sensor carrier carried disposed adjacent the backside of one of the refiner disk segments and housing the plurality of sensor wires;

a sensor connector disposed adjacent the backside of an adjacent one of the refiner disk segments and having an electrical connector to which the plurality of sensor wires connect with the electrical connector disposed in line with the instrument ports; and a conduit arrangement received in the instrument ports of the refiner housing and the stationary refiner disk holder with the conduit arrangement carrying an electrical connector that releasably couples with the electrical connector of the sensor connector.

12. A refiner disk for a rotary disk refiner comprising:

a plurality of refiner disk segments that each have a refining surface defined by a plurality of refiner bars and grooves and a backside;

at least one sensor assembly disposed in a pocket in the refining surface of one of the refiner disk segments and having a plurality of sensor wires extending therefrom;

a sensor carrier disposed adjacent the backside of one of the refiner disk segments and housing the plurality of sensor wires;

a sensor connector disposed adjacent the backside of one of the refiner disk segments and having an electrical connector to which the plurality of sensor wires connect; and a conduit arrangement having an electrical connector that releasably couples with the electrical connector of the sensor connector; and wherein the sensor carrier is mounted to the backside of one of the refiner disk segments, the sensor connector is mounted to the backside of an adjacent one of the refiner disk segments, and further comprising a conduit that houses the plurality of sensor wires extending from the sensor carrier to the sensor connector.

13. The refiner disk of claim 12 wherein the sensor connector comprises a puck that has the electrical connector extending outwardly therefrom.

14. The refiner disk of claim 13 wherein the puck further comprises a pedestal that extends outwardly from a body of the puck and carries a seal, and wherein the electrical connector extends outwardly from the pedestal.

15. The refiner disk of claim 12 wherein there are a plurality of the sensors that are each fixed to the sensor carrier, and wherein the sensor carrier comprises a hollow manifold.

16. The refiner disk of claim 12 wherein the conduit arrangement comprises a rigid and tubular conduit that steam tightly engages the sensor connector.

17. The refiner disk of claim 12 wherein the conduit arrangement comprises a rigid and tubular outer conduit in which a tube is disposed in which sensor wiring housing is disposed.

18. The refiner disk of claim 12 wherein the sensor assembly comprises a tubular base, a frustoconical cap attached to the base with the frustoconical cap having a flat from which a sensing element bulb projects, and a sensing element carried by the sensor element bulb.

19. The refiner disk of claim 18 wherein the base is threadably received in the sensor carrier.

* * * * *